US005176550A

United States Patent [19]

Hooper

[11] Patent Number: 5,176,550

[45] Date of Patent: Jan. 5, 1993

[54] ENGINE PROPELLER BLADE AND LOWER UNIT PROTECTOR

[76] Inventor: Robert P. Hooper, 633½ Rockledge Dr., Rockledge, Fla. 32955

[21] Appl. No.: 806,648

[22] Filed: Dec. 13, 1991

Related U.S. Application Data

[63] Continuation-in-part of Ser. No. 590,361, Sep. 28, 1990, abandoned, which is a continuation of Ser. No. 415,023, Sep. 29, 1989, abandoned.

[51] Int. Cl.[5] ..... B63B 35/85

[52] U.S. Cl. ..... 440/72; 416/247 A

[58] Field of Search ..... 440/71-73; 416/247 A

[56] References Cited

U.S. PATENT DOCUMENTS

| | | | |
|---|---|---|---|
| 2,244,217 | 6/1941 | Pries | 440/72 |
| 3,035,538 | 5/1962 | Willard | 440/72 |
| 3,889,624 | 6/1975 | Balius | 440/72 |

FOREIGN PATENT DOCUMENTS

| | | | |
|---|---|---|---|
| 2152459 | 8/1985 | United Kingdom | 440/72 |

*Primary Examiner*—Jesus D. Sotelo

*Attorney, Agent, or Firm*—Herbert W. Larson

[57] ABSTRACT

The propeller and lower unit protector is made from a high grade steel and has a spring like U-shaped top member for sliding in a generally horizontal direction over an outboard engine cavitation plate from a front to a back portion of the engine. A generally ring shaped member depends downwardly from a first end of the top member and is attached thereto. The ring member is spaced apart outwardly from the outer edges of the propeller blades. The opening in the front of the U-shaped top member is closed by a bolt through a bore in the first end of the top member to secure the top member in a tight grip around the lower engine housing. The closed end of the top member is attached to a strut depending downwardly and backwardly to attach to a bottom portion of the ring member. Port and starboard side struts also connect the downwardly depending strut to a middle portion of the ring member.

9 Claims, 5 Drawing Sheets

ENGINE PROPELLER BLADE AND LOWER UNIT PROTECTOR

PRIOR APPLICATION

This application is a continuation-in-part of my application Ser. No. 07/590,361, filed Sept. 28, 1990 (now abandoned), which is a continuation of my application Ser. No. 07/415,023, filed Sept. 29, 1989 (now abandoned).

BACKGROUND OF THE INVENTION

1. Field of the Invention

This invention relates to propeller and lower unit guards. More particularly, it refers to a quick mount cage type propeller and lower unit protector for outboard and inboard-outboard drive units.

2. Description of the Prior Art

Small engine propeller blade and lower unit protectors of various dimensions and configurations such as a single ring guard around a propeller or a cage type structure as shown in U.S. Pat. Nos. 2,244,217; 3,035,538; 3,889,624; and U.S. Pat. No. 4,0278,516 are well known. Unfortunately, except for Disney World, military landing craft, coastal rescue boats and by a couple of other commercial organizations such propeller blade and lower unit protectors are not widely used. The main reasons for lack of use by the public is the difficulty of mounting the propeller blade and lower unit protector, the inability to remove the guard and a decided decrease in engine revolutions per minute caused by drag from the cumbersome prior art cage type propeller blade and lower unit protectors. To encourage the public to use propeller blade and lower unit protectors to protect swimmers, scuba divers, Manatees and other mammals, as well as underwater plant beds, a simple, ways to mount, inexpensive and minimum drag type propeller blade and lower unit protector is needed.

SUMMARY OF THE INVENTION

I have invented a novel quickly mountable propeller and lower unit protector which not only prevents damage to the propeller blades and the lower unit from underwater obstructions, but more importantly, protects ecologically important underwater plants from root destruction and prevents cutting type injuries to underwater wild mammals and persons in the water. A minimum reduction in engine RPM's is caused by my propeller and lower unit protector.

My propeller and lower unit guard is preferably made from a high grade steel and has a spring like U-shaped top member for sliding on the motor from front to back. A ring member is attached near an open or front end of the top member and depends downwardly from the top member. The open end of the top member has a through bore to receive a bolt and nut to close the two sides forming an opening in the first end of the top member. The bolt and nut secure the top member flush to the engine housing above a cavitation plate. A front strut is attached to a closed end of the top member and depends downwardly and then backwardly to connect with the ring member. A port and starboard side strut also connects the ring member to the front strut.

BRIEF DESCRIPTION OF THE DRAWINGS

The invention may be best understood by those having ordinary skill in the art by reference to the following detailed description when considered in conjunction with the accompanying drawings in which.

DETAILED DESCRIPTION OF THE INVENTION

Figure 1:
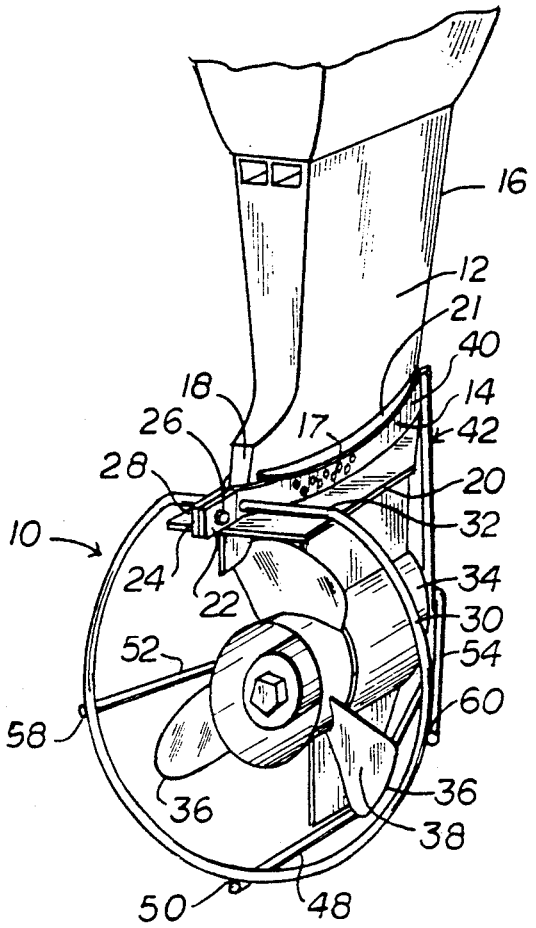
FIG. 1 is a perspective view of the propeller and lower unit protector of the invention mounted on a lower drive unit housing.
Figure 2:
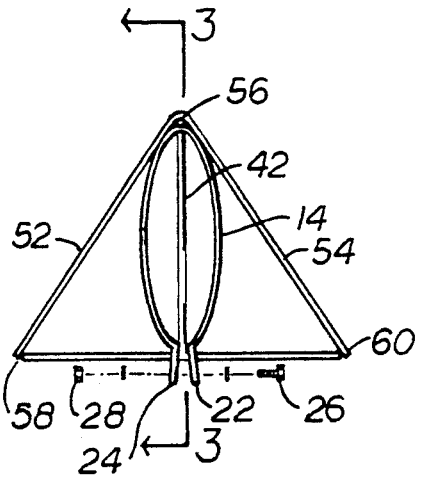
FIG. 2 is a top plan view of the propeller and lower unit protector of FIG. 1.

Throughout the following detailed description, the same reference numerals refer to the same elements in all figures.

The propeller and lower unit protector 10 shown in FIG. 1 is mounted on the lower drive unit 12 of a high speed outboard or inboard-outboard motor. To mount protector 10, its top U-shaped member 14 is pushed from the front 16 of the engine to the back 18 of the engine just above the engine's cavitation plate 20 and below its horizontal plate 21.

Figure 8:
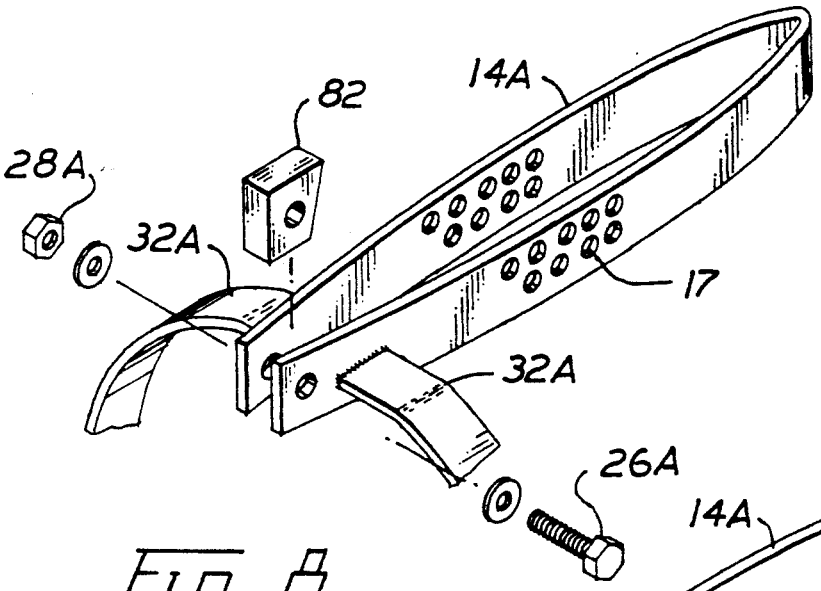
FIG. 8 is a fragmentary perspective view of a circular strap attachment to a top U-shaped member of the propeller protector.

The top member 14 is U-shaped in configuration and has arms 22 and 24 meeting at an open end of the top member 14 beyond the rear portion 18 of the engine. The ends 22 and 24 are held together by a bolt 26 which has a corresponding nut 28. Clamping together of arms 22 and 24 around the lower drive unit 12 by bolt 26 and nut 28 securely holds the top member in place flush around the housing from the front to the back portion of the lower drive unit 12. It is preferred to place a block 82 between the two arms as shown in FIG. 8. Holes 17 in the arms 22 and 24 permit cooling water to flow out of the lower drive unit. Depending from a portion near the open end of the top member 14 is a generally circular or ring shaped member 30. Member 30 can be either welded or otherwise attached to the ends 22 and 24 of top member 14. The ring shaped member is flat along its top surface 32 so as to not interfere with the structure of cavitation plate 20. However, thereafter, the ring member is rounded along both the starboard 34 and port side, not shown, of the engine. The ring member 30 is spaced apart from the outer edges 36 of the propeller 38.

At a closed end 40 of the top member 14 a strut 42 is attached, usually by welding, at a right angle to the top member 14. The strut 42 depends downwardly from the top member 14 along a first portion 44 and then bends at point 46 and depends downwardly along portion 48 to an attachment at 50, usually by welding, to the ring member 30. Attachment 50 is at a bottom portion of the ring member 30. A port strut 52 and a starboard strut 54 are each joined at point 56 to the front strut 42 along portion 44 and are joined to the ring member 30 at points 58 and 60, respectively. The port and starboard struts may be faired into the ring member 30 and front strut 42 to achieve a smooth surface and reduced drag.

Figure 4:
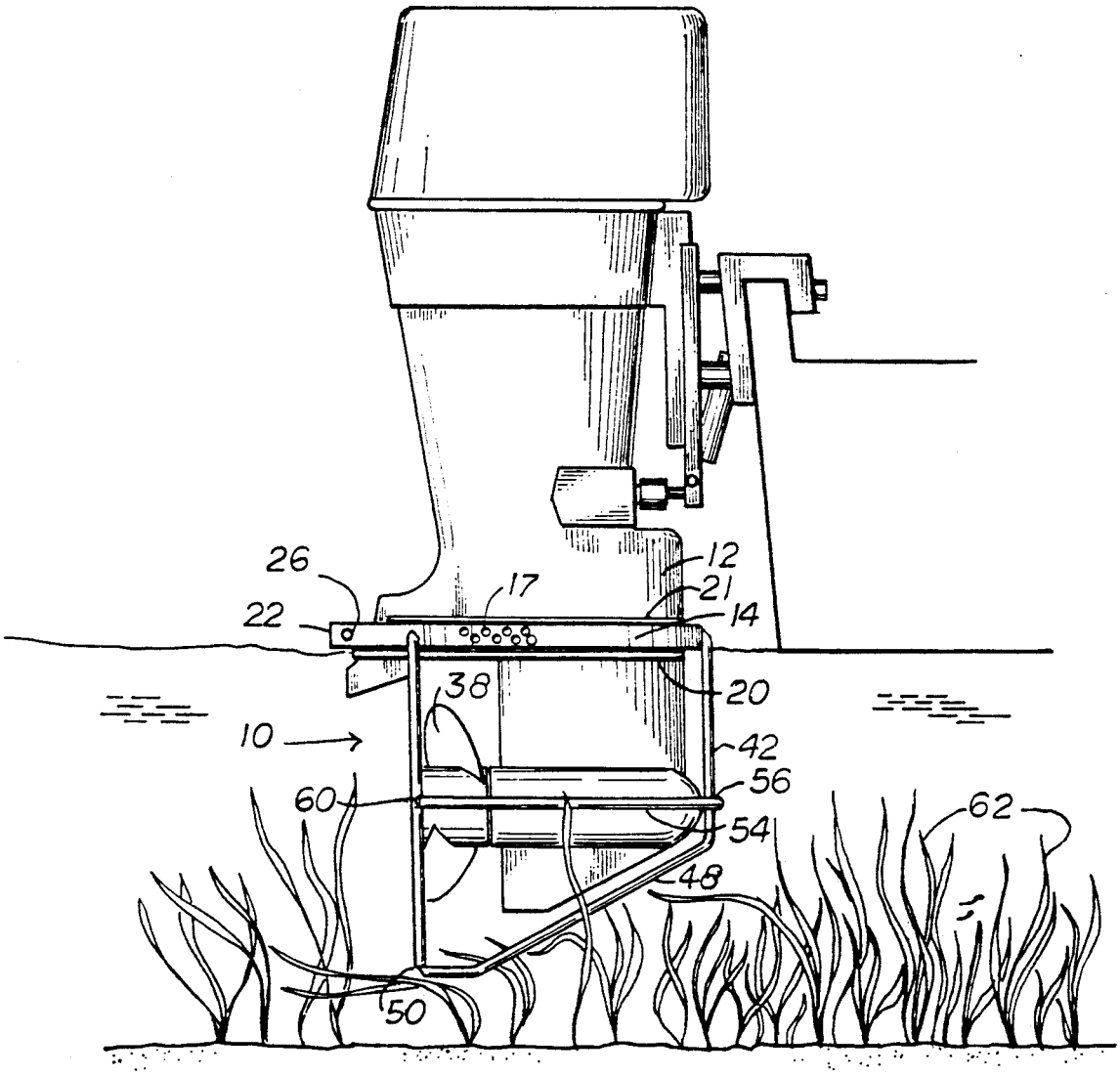
FIG. 4 is a starboard side elevation view of the propeller and lower unit protector on an engine parting an underwater grass bed.
Figure 5:
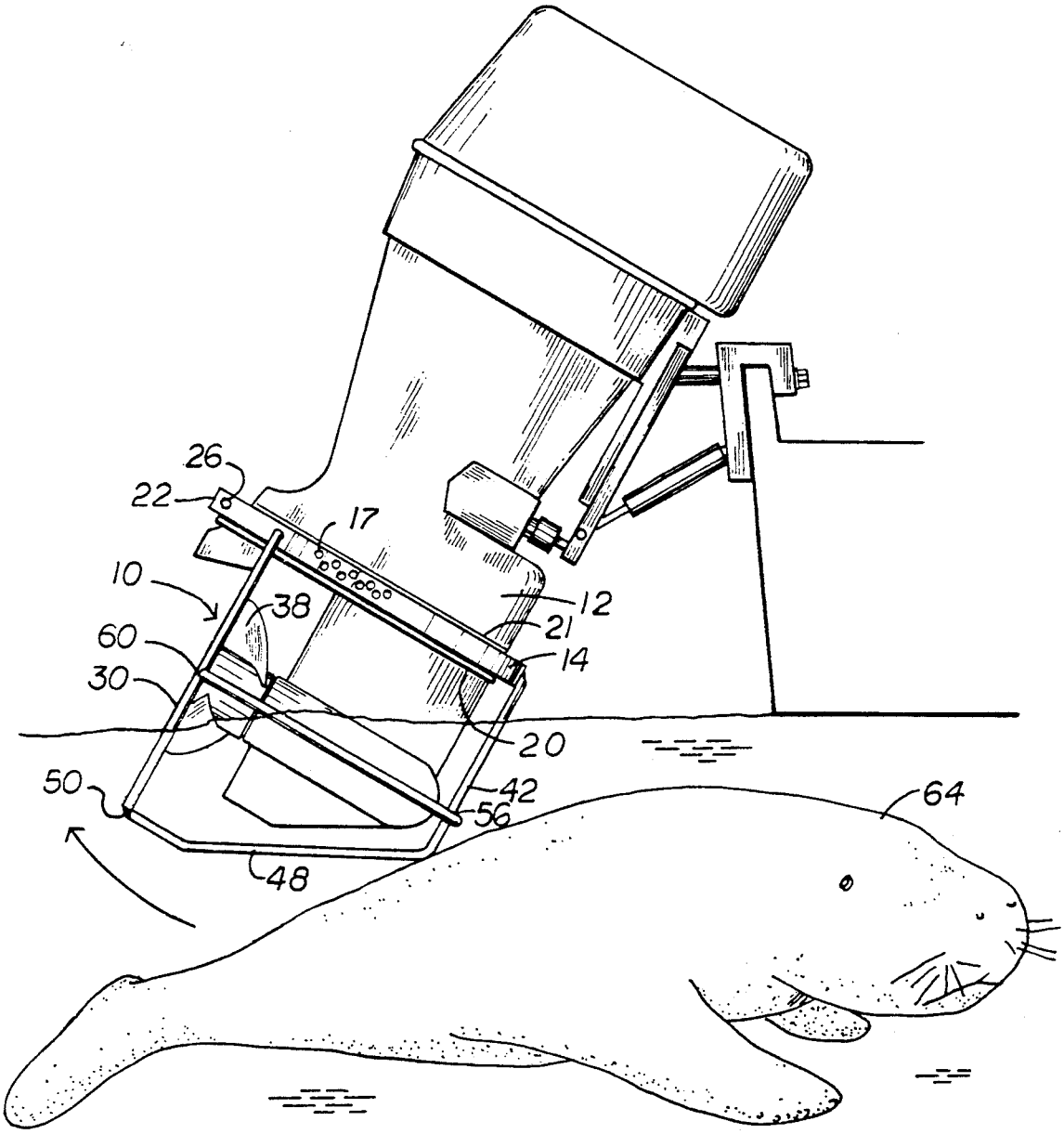
FIG. 5 is a starboard side elevation view of the propeller and lower unit protector preventing a cutting injury to a Manatee.

The modified cage structure of the propeller and lower unit guard 10 ensures that the RPM of the propeller will not be significantly diminished but at the same time provides protection to underwater grasses 62 as shown in FIG. 4. As the engine lower unit goes through a vegetation area, the grasses are brushed aside and are not directly chopped by the propeller 38. A chopping action by the propeller will actually going out the roots of the plants from the sandy subsoil and permanently destroy the plants. This device prevents this gouging of the subsoil by the propeller and generally brushes the underwater grasses aside and does no harm as the boat goes through an area containing such grasses. In addition, as shown in FIG. 5, if the lower unit of the engine strikes a mammal, such as a Manatee 64, the forward portion of the propeller and lower unit protector 10 will bump the Manatee and this will cause the engine to rise up. The propeller 38 will not be able to cut the back of the Manatee. Although the Manatee may still be bumped and injured by an impact force, it has been found that the vast majority of Manatees are killed by boat propellers. After a Manatee is cut by a propeller the wounds rarely heal and an infection sets in and soon after, the Manatee dies.

It is also noted that very severe injuries to divers and swimmers have been caused by the propellers of engines mangling hands and legs. Although the impact of an engine at high speed, if it strikes the head of a swimmer, could kill that swimmer, the device of this invention will protect the swimmer from the cutting action of the propeller. Assuming the head of the swimmer is not impacted by the engine, the injury to the swimmer will be minor if the propeller and lower unit protector of my invention is employed.

Figure 3:
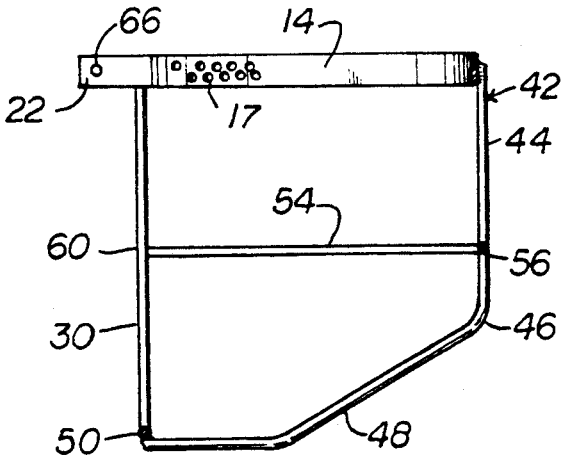
FIG. 3 is a starboard side elevation view of the propeller and lower unit protector.

The propeller and lower unit protector 10 is generally made of high strength anti-corrosive steel but with sufficient flexibility in the top member 14 to allow for spring type movement of arms 22 and 24. A bore 66 through the two arms 22 and 24 as shown in FIG. 3 allows for the arms to be pressed together by the bolt 26 and nut 28 to keep the propeller and lower unit protector securely fastened to the lower unit of the engine. This single bolt allows for a quick mounting or removal of the propeller and lower unit protector as needed by the boat operator. The high strength steel in the struts 42, 52 and 54, as well as in the ring member 30, ensures structural integrity to the unit. However, it is possible for the propeller and lower unit protector to be made from a high strength plastic, wherein all the parts are molded together in a single integral unit or by a welded aluminum structure, having high strength aluminum struts and ring member attached.

The exact dimensions of the propeller and lower unit protector 10 will vary depending on the size of the engine. Generally, however, just a few sizes will enclose the lower unit of engines from less than 10 horsepower on up to 300 or more horsepower.

Figure 6:
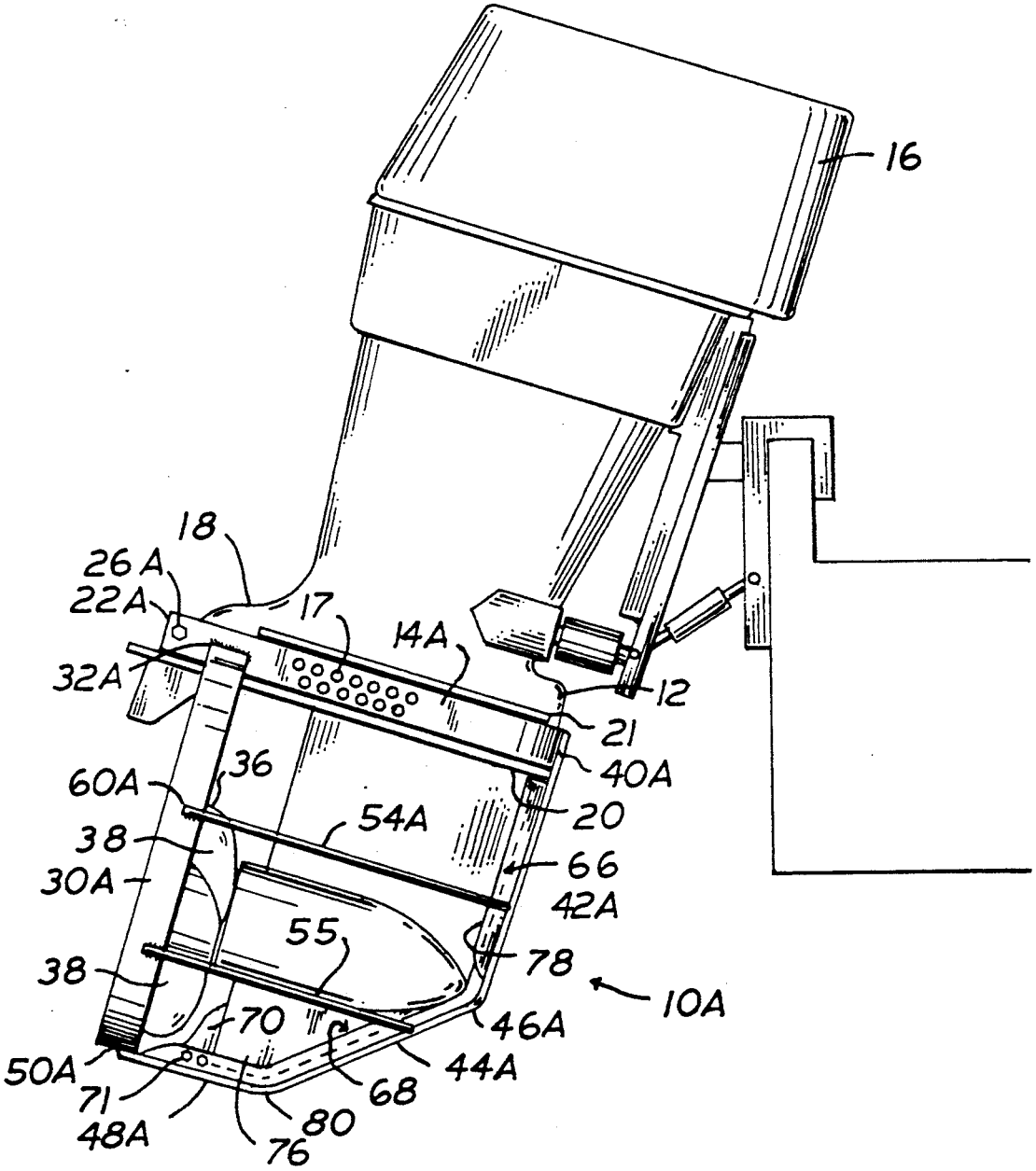
FIG. 6 is a starboard side elevational view of an alternate propeller and lower unit protector mounted to the lower drive unit of an outboard engine.
Figure 7:
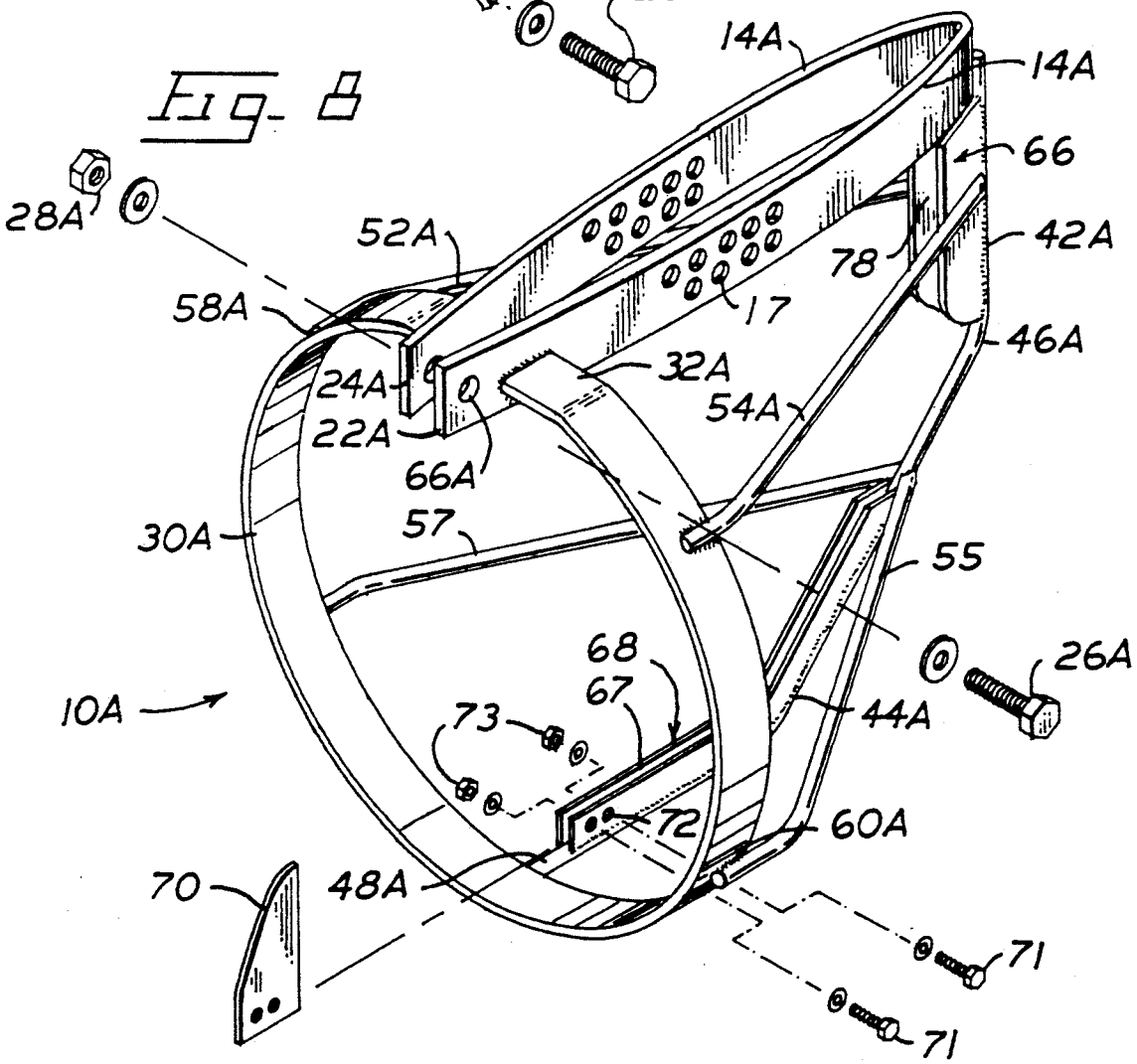
FIG. 7 is a perspective view of the alternate propeller and lower unit protector.

An alternative protector shown in FIGS. 6 and 7 provides even greater protection to the engine lower unit 12 and decreases the protector's effect on the boat speed and turning effort. The alternative protector 10A has a top U-shaped member 14A that is pushed from the front 16 of the engine to the back 18 of the engine just above the cavitation plate 20 and below the horizontal plate 21.

The top member 14A is U-shaped in configuration and has arms 22A and 24A meeting at the open end of the top member 14A beyond the rear portion 18 of the engine. The ends of arms 22A and 24A are held together by a bolt 26A which has a corresponding nut 28A. A block 82 inserted between the ends provides proper spacing to compensate for the squared off ends of most engines. Clamping together of arms 22A and 24A around the lower drive unit 12 by bolt 26A and nut 28A securely holds the top member 14A in place flush around the lower drive unit housing 12 from a front to a back end of the lower drive unit. Holes 17 in the arms 22A and 24A permit cooling water to flow out of the lower drive unit 12.

Depending from near the open end of the U-shaped member 14A is a generally circular or ring shaped strap 30A. A top portion 32A is flat to conform to the engine cavitation plate 20. Strap 30A can be either welded or otherwise attached to the ends of arms 22A and 24A. Circular strap 30A is spaced apart from the outer edges of blades 36 on propeller 38. Usually the space between the inner edge of the strap 30A and blades 36 is about $\frac{3}{4}$ to 1 inch. The back edge of strap 30A should be about $\frac{1}{2}$ inch astern of a back edge of the propeller blades 36.

At a closed end 40A of the top member 14A, a front strut 42A is notched into the top member 14A and held in place permanently, usually by welding. The front strut 42A depends downwardly at a right angle from end 40A and has a pair of flanges 66 integrally attached, usually by welding. The flanges 66 form an inward channel 78, in which the front edge of the lower drive unit 12 is positioned and held in place substantially flush with strut 42A. The front strut 42A bends at point 46A and depends downwardly to point 80 and then backwardly along portion 48A to an attachment 50A to the ring strap 30A. The attachment is usually by welding. A pair of flanges 68 are attached to strut 42A below point 46A and up to attachment point 50A. Flanges 68 form a channel 67 that receives and holds a lower edge of strut 76 substantially flush with strut 42A. Holes 72 at a back end of flanges 68 hold a retainer plate 70 in position with bolts 71 and nuts 73. The retainer plate 70 prevents the lower unit from moving backwards out of the protector 10A.

A top port strut 52A connects at 58A to the ring strap 30A and top starboard strut 54A connects the front strut 42A to the circular strap 30A. A lower port strut 57 and lower starboard strut 55 also connect the front strut 42A to the circular strap 30A. Circular strap 30A is welded at an end of portion 32A at each side to the top member 14A. A type of attachment 60A of the starboard struts 55 or 54A to circular strap 30A is done by welding. In like manner, the other struts are attached to either strap 30A or front strut 42A. The front end of the starboard and port struts are faired into strut 42A. By mounting the front edge of the lower unit 12 in channel 78 and the lower edge of skeg 76 in channel 67, together with bolting retainer plate 70 to the back end of flanges 68, the lower unit is held firmly in place and will not wobble at high speeds or on sharp turns, Therefore, drag is reduced and loss of RPMs is reduced.

Having thus described the invention, what is claimed and desired to be secured by Letters Patent is:

1. A propeller and lower drive unit protector for high speed outboard and inboard-outboard engines having an upper power unit and a lower drive unit comprising a U-shaped top member for sliding in a generally horizontal direction over a cavitation plate from a front to a back portion of the lower drive unit, the top member being flush with a housing for the lower drive unit from the front to the back portion of the lower drive unit, a generally ring shaped member attached adjacent an open end of the U-shaped top member and depending downwardly from the top member with the ring shaped member spaced apart from outer edges of the propeller, a means for clamping together the open end of the U-shaped top member to secure it around a lower engine drive unit housing in a close flush fit, a front strut attached at a first end to a closed end of the U-shaped top member, the front strut depending downwardly and backwardly to connect with a bottom portion of the ring shaped member at a second end, and at least one port and starboard side strut connecting a middle side port and starboard portion of the ring member to the front strut.

2. A propeller and lower unit protector according to claim 1 wherein the means for closing the open end of the U-shaped member is a bore through the open end and a bolt through the bore held in place by a nut.

3. A propeller and lower unit protector according to claim 1 wherein the top member, ring shaped member and all struts are made from an anti-corrosive steel and are welded together.

4. A propeller and lower unit protector according to claim 1 wherein the top member, ring shaped member and all struts are made from a high strength plastic and are integrally connected.

5. A propeller and lower unit protector according to claim 1 wherein the top member, ring shaped member and all struts are made from high strength anti-corrosive aluminum and are integrally connected.

6. A propeller and lower unit protector according to claim 1 wherein the top member, ring shaped member and all struts are made from a stainless steel and the struts are faired into the ring shaped member.

7. A propeller and lower drive unit protector according to claim 1 wherein the front strut has an integral first pair of flanges proximal to a front edge of the lower drive unit for enclosing and seating the front edge of the lower drive unit in a substantially flush fit.

8. A propeller and lower unit protector according to claim 7 wherein there are two port and starboard side struts parallel and spaced apart from each other and a lower portion of the front strut has an integral second pair of flanges proximal to a skeg at a bottom end of the lower drive unit for enclosing and seating a lower edge of the skeg in a substantially flush fit.

9. A propeller and lower unit protector according to claim 8 wherein a back end of the second pair of flanges has a safety plate bolted to the second pair of flanges to prevent against backward movement of the lower drive unit.

* * * * *